United States Patent [19]

Anderson

[11] 4,360,295

[45] Nov. 23, 1982

[54] COMBINATION GRAVITY/PNEUMATIC HOPPER BOTTOM

[75] Inventor: Arthur I. Anderson, St. Paul, Minn.

[73] Assignee: North American Car Corporation, Chicago, Ill.

[21] Appl. No.: 162,887

[22] Filed: Jun. 25, 1980

[51] Int. Cl.[3] ..... B65G 53/40

[52] U.S. Cl. ..... 406/75; 406/90; 406/130; 406/134; 406/138; 105/282 P

[58] Field of Search ..... 406/75, 90, 122, 128, 406/130, 134, 138; 105/282 R, 282 A, 282 P

[56] References Cited

U.S. PATENT DOCUMENTS

| | | | |
|---|---|---|---|
| 2,190,727 | 2/1940 | McKenna | 406/122 |
| 2,926,963 | 3/1960 | Dorey . | |
| 3,020,093 | 2/1962 | Dorey . | |
| 3,138,117 | 6/1964 | Dorey | 406/130 X |
| 3,182,954 | 5/1965 | Borger | 406/130 |
| 3,325,223 | 6/1967 | Price . | |
| 3,343,886 | 9/1967 | Kemp et al. | 406/130 |
| 3,343,887 | 9/1967 | McNamara | 406/122 |
| 3,397,654 | 8/1968 | Snyder . | |
| 3,439,957 | 4/1969 | Floehr . | |
| 3,451,726 | 6/1969 | Nagy . | |
| 3,826,203 | 7/1974 | Martin et al. | 105/282 P |
| 4,057,155 | 11/1977 | Deeks . | |
| 4,253,400 | 3/1981 | Fischer et al. | 105/282 A X |

FOREIGN PATENT DOCUMENTS

| | | |
|---|---|---|
| 188433 | 3/1964 | Sweden . |

*Primary Examiner*—Jeffrey V. Nase

*Attorney, Agent, or Firm*—Lockwood, Dewey, Alex & Cummings

[57] ABSTRACT

A bottom assembly for a hopper vehicle is adapted to permit safe pneumatic unloading as well as gravity unloading of a hopper. The bottom assembly includes a membrane mounted to be moved over and away from a hopper bottom opening, and sealing devices for insuring a secure seal for the hopper which can be easily set. A discharge manifold is connected to the hopper at a location spaced from the hopper bottom opening, and the hopper bottom opening is contained in a plane which is tilted with respect to the horizontal.

26 Claims, 11 Drawing Figures

COMBINATION GRAVITY/PNEUMATIC HOPPER BOTTOM

BACKGROUND OF THE INVENTION

The present invention relates in general to hopper transport vehicles, and, more particularly, to a bottom for the hoppers of such vehicles.

Hopper vehicles include trucks, railroad cars, and the like, and are used to transport many materials, such as granular products, liquid products, and the like. The problems involved in unloading such vehicles have engendered many inventions, see, for example, co-pending Patent Application Ser. Nos. 137,438, filed Apr. 3, 1980, and 144,850, filed Apr. 29, 1980 by the present assignee, and incorporated herein by reference thereto.

Many unloading systems involve pressurizing the hopper and forcing the product into a discharge manifold. Such unloading systems will be referred to hereinafter as pneumatic unloading systems. Other unloading systems involve gravity unloading wherein product is discharged out of the hopper bottom.

There are situations where pneumatic unloading is more efficient than gravity unloading, and vice versa. Accordingly, there is need for a hopper vehicle which is capable of being unloaded by pneumatic unloading procedures and by gravity unloading procedures.

SUMMARY OF THE INVENTION

A hopper vehicle using the hopper bottom embodying the teachings of the present invention can be unloaded using a pneumatic procedure or using gravity procedures only, whichever is more convenient and expeditious.

The hopper includes a product discharge manifold connected to the hopper through which product is discharged during a pneumatic unloading procedure. The hopper has an open bottom on which is mounted closure apparatus. The closure apparatus includes a membrane which is mounted to be moved over the hopper bottom or away from the hopper bottom. A rack and pinion assembly is used to move the membrane. In one embodiment, the membrane is fabric and air is circulated through that membrane to produce aeration and an airsweep effect which assists in the unloading of the hopper as fully discussed in the referenced patent applications.

In one embodiment of the hopper bottom cover, the membrane closure apparatus includes a plurality of clamping bolts which sealingly secure a membrane support over the hopper bottom. Another embodiment includes cams which sealingly secure a membrane support over the hopper bottom.

Aeration and fluidization are effected using an air system which includes a flexible hose and an air duct in one embodiment, and fluidization devices in another embodiment. A vibration producing system is used in conjunction with a fluid impervious membrane, which can be formed of metal and the like.

In gravity unloading procedures, the rate of discharge can be controlled by moving a closure assembly to open more, or less, of the hopper bottom opening.

The discharge manifold is connected to the hopper and not to the bottom cover assembly. Thus, repair, replacement, or the like can be carried out on the cover assembly without disturbing the discharge manifold. Much time and effort can thus be saved. The bolts and/or cams insure a seal which is secure enough to permit complete pressurization of the car while personnel are in the area, yet are easily set and released. Ramp blocks are also included to further enhance the sealing of the hopper bottom.

Vibration and/or fluidization further enhances the unloading of the hopper, and the hopper bottom assembly is tilted toward the discharge manifold to insure complete emptying of the hopper.

The discharge manifold has a shutoff valve and can be easily closed during gravity discharge. As discussed in the referenced patent applications, some prior systems have the discharge manifold connected to a hopper bottom assembly, and this discharge manifold must be removed during servicing, or the like. Such removal is time consuming and wasteful.

Efficient cleanout can be effected using the device embodying the teachings of the present invention. Pressure can be used while the bottom assembly is in the gravity unloading configuration to effect such cleanout.

OBJECTS OF THE INVENTION

It is the main object of the present invention to provide versatility to a hopper vehicle by allowing either gravity or pneumatic discharge thereof, while insuring complete emptying of the hopper in either mode.

It is another object of the present invention to permit easy change over from one discharge mode to the other.

It is still another object of the present invention to insure the sealing of a hopper bottom cover assembly which is secure enough to permit complete pressurization of a hopper during pneumatic discharge procedures while personnel are located in the vicinity of the hopper vehicle.

It is yet another object of the present invention to insure complete discharge of essentially all of the product located in a hopper vehicle which can be emptied using either pneumatic or gravity procedures.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
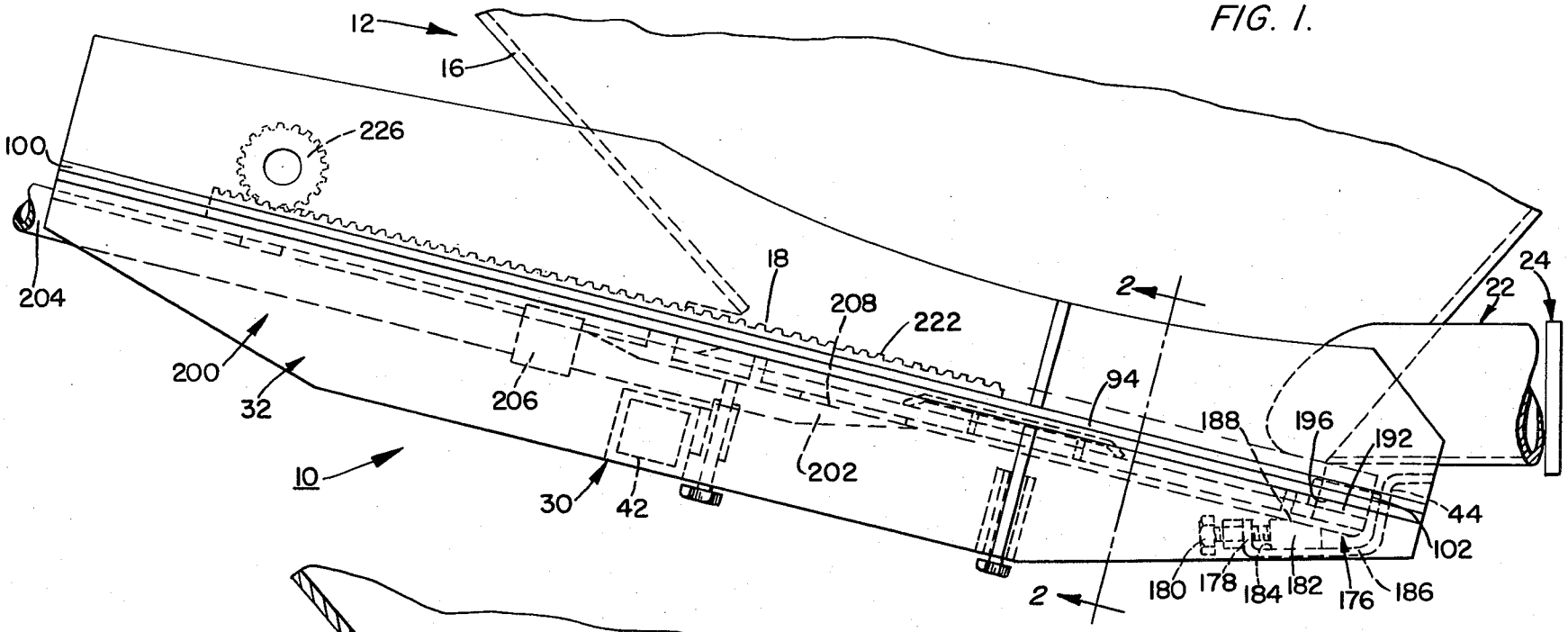
FIG. 1 is an elevation of a hopper bottom assembly embodying the teachings of the present invention.

Shown in FIG. 1 is an understructure 10 of a hopper 12 used on a transport vehicle, such as a railroad car, or the like. The hopper has a conical bottom wall 16 with an opening 18 defined therein. The opening 18 is in a plane which is slanted with respect to the horizontal, preferably 15°, so that material may be influenced toward a discharge manifold 22 located in a lower portion of the hopper wall and having a control valve 24 thereon.

The hopper 12 can be unloaded through the discharge manifold using pneumatic unloading procedures, or through opening 18 in a gravity assisted manner so that the transport vehicle is versatile and can be efficiently unloaded at a variety of unloading depots.

A hopper bottom closure structure 30 permits the hopper to be unloaded either through the discharge manifold or through opening 18, and is the subject of the present disclosure.

A housing 32 includes a pair of elongate side members 34 and 36 which in spaced parallelism with each other and each of which includes a pair of L-shaped flanges 38 coupled together at the short legs thereof by fasteners, such as bolt 40, or the like. One of the flanges of each side member is attached to the hopper wall 16 by welding or the like so that the side members depend downwardly from the hopper and are positioned to slope with respect to the horizontal at an angle corresponding to that of the plane containing the hopper discharge opening 18, as best shown in FIG. 1.

A polygonal brace 42 extends across the hopper opening and is attached at the ends thereof to the lower flanges of the side members. A second brace 44 extends across the hopper opening and is located adjacent one end of the side members. The purpose and operation of these braces will be evident from the ensuing disclosure.

Figure 2:
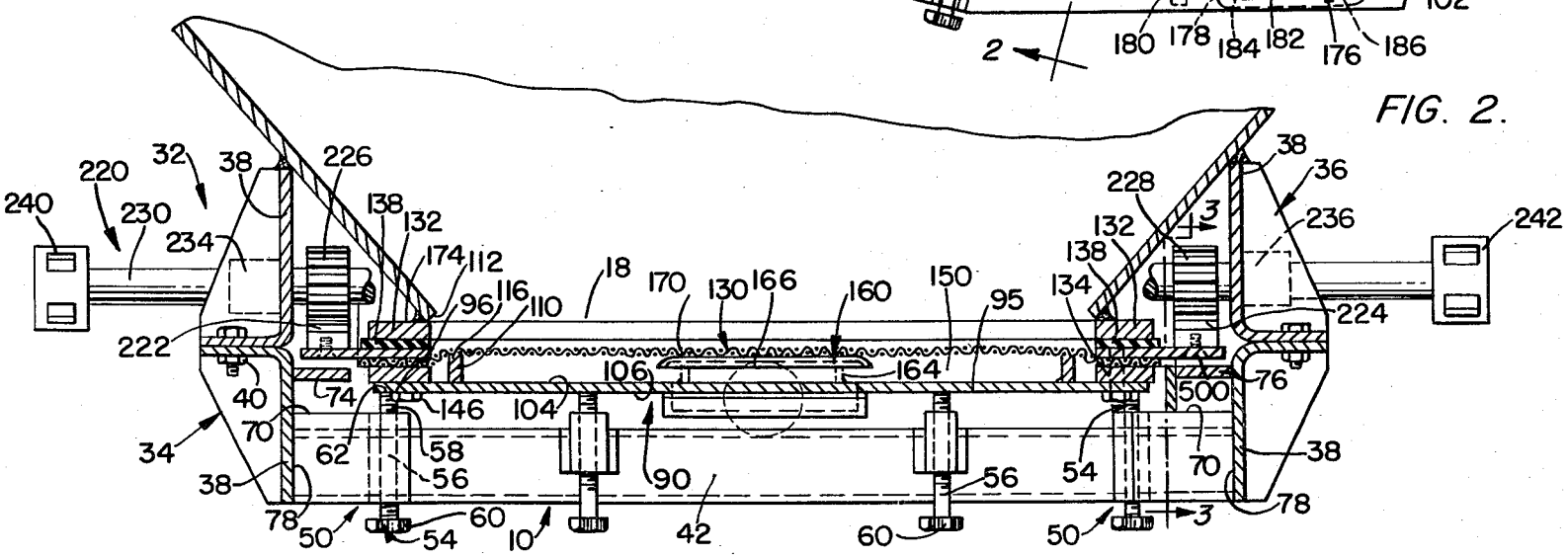
FIG. 2 is a view taken along line 2—2 of FIG. 1.
Figure 6:
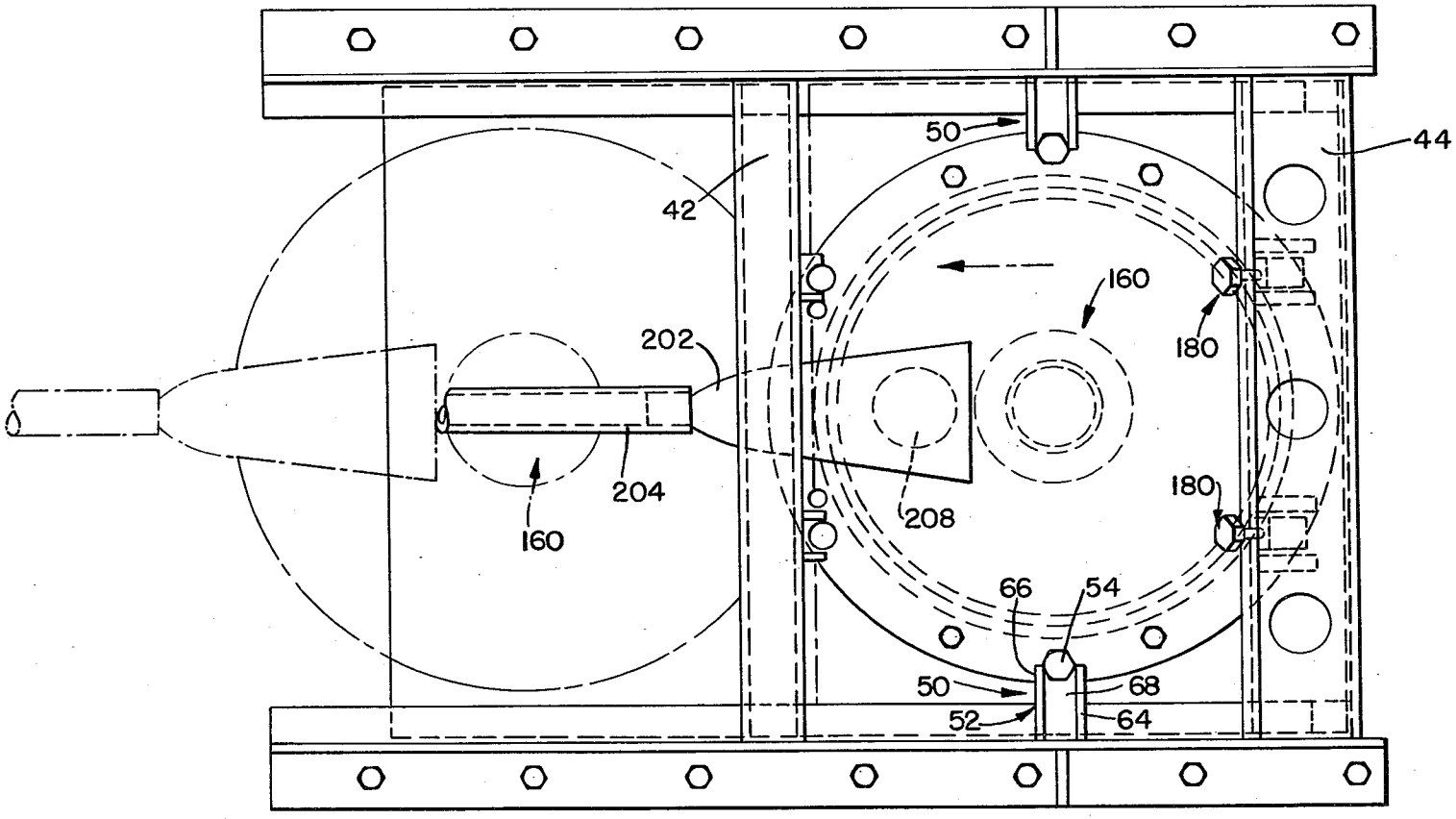
FIG. 6 is a bottom view of a hopper bottom assembly embodying the teachings of the present invention.

As best shown in FIGS. 2 and 6, a plurality of clamping bolt elements 50 are mounted on the side members and the brace 42. Each of these elements includes a collar-like mounting 52 extending inwardly of the area defined by the braces and the side members, and a bolt 54 is threadably received in the collar-like element. The bolts are best shown in FIG. 2 to include a shank 56 having threads 58 defined thereon, a head 60 at one end of the shank with a top end 62 on the other end of the shank. The bolts are vertically oriented and thus move vertically when turned. Each collar-like element includes a pair of flanges 64 and 66 attached as by welding or the like to the brace and/or the side members to be vertically oriented and in spaced parallelism with each other. A spanner portion 68 is interposed between the flanges and is securely affixed thereto. As shown in FIG. 2, the collar-like elements have top surfaces 70 which are all in a common plane. As above, the function and operation of these clamping bolts will be evident from the ensuing discussion.

A pair of guide rails 74 and 76 are affixed to the inside surfaces 78 of the side member lower flanges to extend essentially the entire length of the side members.

A membrane support assembly 90 is slidably mounted in the cover structure, as best shown in FIGS. 2–6. the membrane support assembly includes a rectangular sliding gate 94 and a circular planar plate 95 located beneath the hopper opening 18 and above the clamping bolt elements. The gate 94 has edges 100 and 102, and the plate 95 has top surface 104 and bottom surface 106, whereas the gate 94 has top surface 107 and bottom surface 108. An annular membrane support 110 is mounted by welding or the like on the plate top surface, and is located to be inwardly circumjacent lowermost edge 112 of the hopper wall defining the hopper opening 18. The support has a top surface 116.

A membrane 130 is mounted on the plate by annular mounting flanges 132 and 134 which are circumferentially disposed on the membrane and which sandwich that membrane therebetween. The flange 132 can be affixed to the hopper wall is so desired by welding or the like, or can be formed with the hopper wall. Circular flange 134 is welded to the plenum plate at point 96, and this assembly bolts to the sliding rectangular gate 94 with the membrane sandwiched in between. There is a hole in the rectangular sliding gate with a diameter equal to the inside diameter of flanges 132 and 134. A gasket 138 is sandwiched between upper surface of sliding plate and flange 132 which is welded to the hopper. Bolts 146, or like fasteners, secure the plenum plate and flange assembly 132 to the sliding plate with the membrane held between. As the gate slides gasket 138 is held to hopper flange 132 with an adhesive.

As best shown in FIG. 2, the membrane 130 is stretched taut over the annular membrane support to be spaced above the plenum plate top surface 104 to thereby define a plenum 150.

A mushroom membrane support 160 is mounted on the plenum plate to be at or near the center of the membrane. The mushroom support includes a tubular body 164 affixed to the plate top surface 104 and a top 166 attached to the tubular body. The top 166 has an uppermost surface 170 which contacts the membrane 130 and preferably is co-planar with the membrane support top surface 116 so that the membrane is essentially planar in the area defined by the annular membrane support 110. Upper mounting flange 132 has a top surface 174 and is welded to the hopper lowermost edge 112 so that sealing occurs at the lower surface 132. The just-discussed seal is secure enough to withstand pressures generated internally of the hopper during loading, transport and pneumatic discharge of material.

This seal is effected by forcing the clamping bolts upwardly against the base plate bottom surface, thereby lifting the entire membrane support assembly 90 toward the hopper bottom. Sufficient torque can be exerted on the bolts to effect a seal between the mounting flange and the hopper bottom which is secure enough to permit safe pressurization of the hopper even when personnel are in the immediate vicinity of the hopper.

This sealing fit is enhanced by batten means 176 mounted on the brace 174. As best shown in FIGS. 1 and 6, the brace 44 is zig-zag in cross-sectional shape and includes a flange 178 on the end thereof presented toward the brace 42. A pair of jam bolts 180 are threadably secured in the flange 178 and a clamping jam block 182 is attached to each of the bolts. The clamping block is mounted on the inside surface 184 of the brace web 186 to be moved by the bolt to which it is connected. Each jam block is pentagonal in shape with a ramp 188 on the surface thereof presented away from the brace web inside surface 184. The ramp is jammed into contact with the plate bottom surface 106, and by torquing the jam bolts, the base plate, and hence the upper flange surface, is forced toward and against the hopper bottom wall as shown in FIG. 1.

Figure 3:
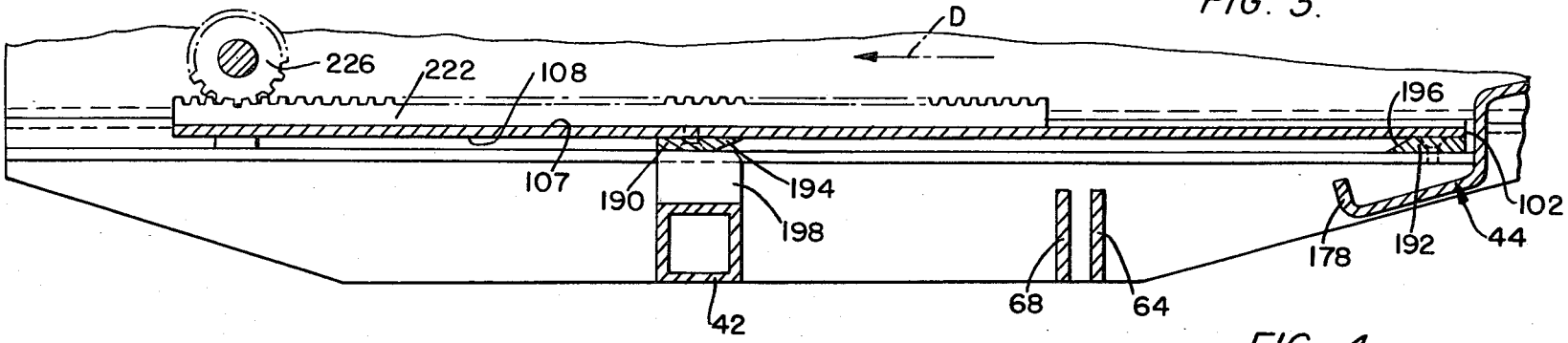
FIGS. 3-5 are views taken along line 3—3 of FIG. 2 showing the operation of the hopper bottom assembly embodying the teachings of the present invention and which have been tilted toward the horizontal as shown for the purpose of economy of space in the drawings.
Figure 4:
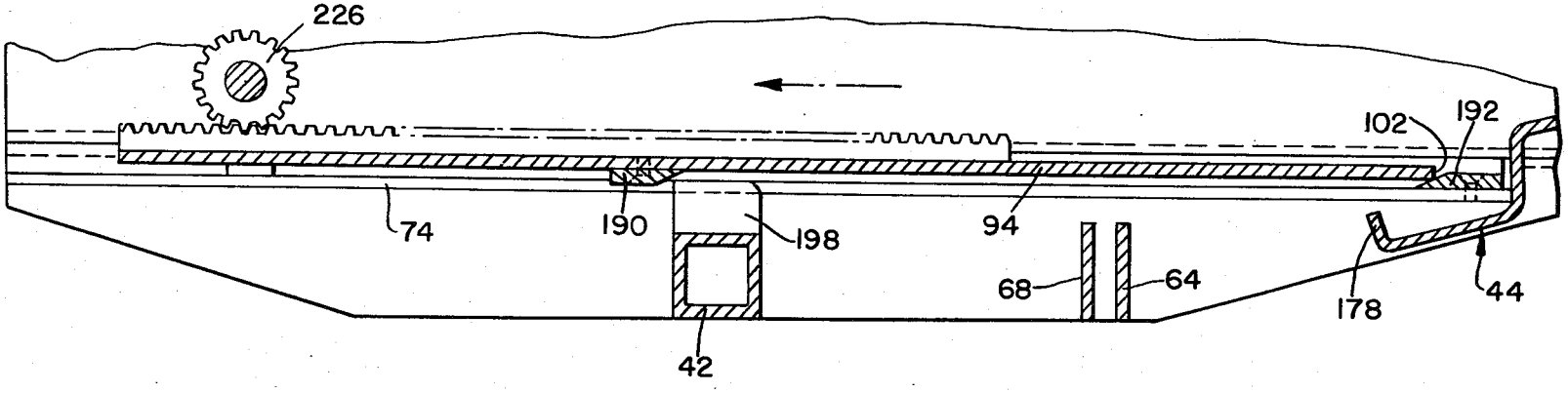
Figure 5:
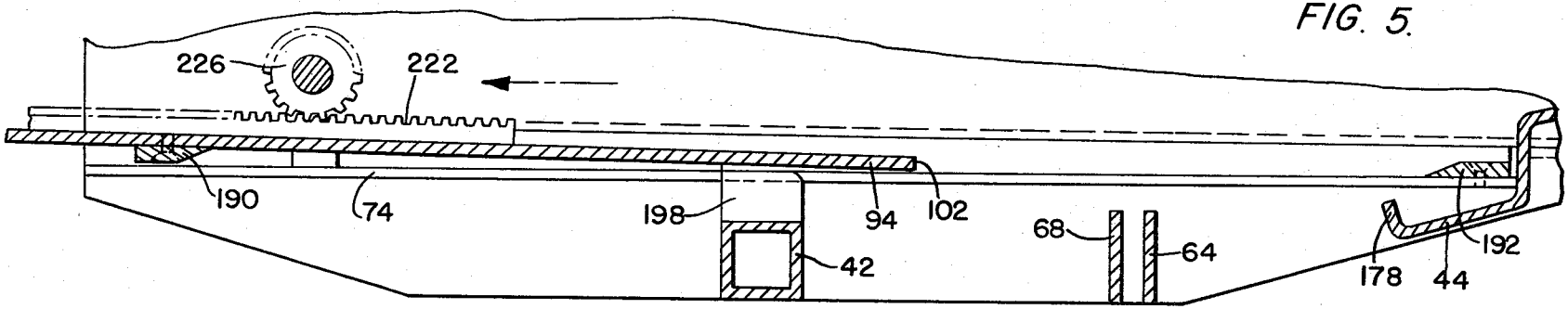

Sealing of the hopper by the support assembly is further insured by ramp block pairs 190 and 192 best shown in FIGS. 3–5. Ramp blocks 190 are under-bevelled to define ramps 194 and are attached by set screws or the like to the base plate bottom surface 106 to present the ramps downwardly. The ramp blocks 192 are over-bevelled to define ramps 196 which are presented upwardly and are attached by set screws or the like to flanges 74 and 76. The ramp blocks force the assembly upwardly when the assembly is in the hopper closing position shown in FIG. 3.

The brace 42 has an extension 198 thereon which contacts the ramp blocks 190. The operation of the ramp blocks is evident from the above description, and will be made further evident from the ensuing discussion.

As best shown in FIG. 1, an air induction system 200 includes an air duct 202 mounted on the base plate bottom surface and a flexible air hose 204 coupled to the air duct by a coupling 206. An air inlet port 208 is defined through the base plate to fluidly couple the air induction system with the plenum 150. The membrane is preferably foraminous, and thus air inducted into the plenum 150 will flow through the membrane into the hopper 12 to thereby fluidize and agitate material located in that hopper. Such air induction is especially useful during unloading procedures, as was discussed in the referenced patent applications.

An assembly moving system 220 is mounted on the housing 32 and includes a pair of racks 222 and 224 mounted on opposite sides of the hopper as by bolting to gate 94, and a pair of pinions 226 and 228 mounted on a shaft 230 for rotation therewith. The pinions are meshed with the racks as best shown in FIGS. 1 and 2. The shaft extends through the upper flanges 38 and is held thereon by bearings 234 and 236. Couplings 240 and 242 are positioned on the shaft to connect that shaft to a driving means (not shown) for rotating the shaft. Two couplings are used so that the assembly 90 can be moved from either side of the transport vehicle. Rotation of the shaft is transferred via the rack and pinion to the membrane support assembly for sliding that assembly between a first position covering the hopper bottom opening and a second position uncovering the hopper bottom opening. The rotation of the shaft is translated into rectilinear motion of the support assembly by the rack and pinion.

Operation of the hopper device assembly is best illustrated in FIGS. 3–6 and attention is directed thereto. In the FIG. 3 position, the hopper assembly is unloaded via the discharge manifold 22 in a manner described in the referenced patent applications, wherein air is ingested into the hopper via the membrane to define an airsweep and fluidization effect, and pressurization is used to force the material into the discharge manifold. The clamping bolt assemblies 50 are securely tightened and the ramp blocks 190 and 192 are securely jammed against the corresponding structure to assure a pressure tight seal. The closing position for the hopper bottom closure assembly 90 is shown in full lines in FIG. 6.

If a gravity-assisted unloading procedure is to be effected via the hopper bottom opening 18, the hopper closure assembly 90 is moved into the open position shown in phantom lines in FIG. 6. The coupling 240 is rotated by hand using a bar inserted into complementary slots provided in the coupling, however, it is noted that an air motor wrench could be used if so desired, the clamp bolts 54 are removed, the jam block bolts 180 are loosened, and the jam blocks 182 are moved away from the FIG. 1 position. These blocks 182 can be completely removed if desired. The plate 94 and hence the closure assembly can then drop from the FIG. 2 position downwardly until the sliding gate contacts the support flanges 74 and 76 respectively; however, the ramp blocks prevent this dropping from occurring immediately. The closure assembly is thus in the FIG. 3 orientation and arrangement. The pinion is rotated, and hence moves the closure assembly in the direction indicated by arrow D in FIGS. 3–6. It is noted that flanges 74 and 76 prevent the assembly from dropping far enough to disengage the rack from the pinion.

The assembly drops downwardly when the ramp blocks 190 move off the brace extensions 198 and the base plate moves off the ramp blocks 192, as indicated in FIGS. 4 and 5. Continued rotation of the pinion draws the assembly, and hence the membrane, out of the obturating position over the hopper opening 18. The air hose 204 flexes during the opening operation.

Moving the assembly back into a covering and sealing position is simply the reverse of the above-discussed operation, and thus will not be presented for the sake of brevity.

An alternative embodiment of the hopper closure assembly is shown in FIGS. 7–11, and attention is now directed to those figures.

Figure 7:
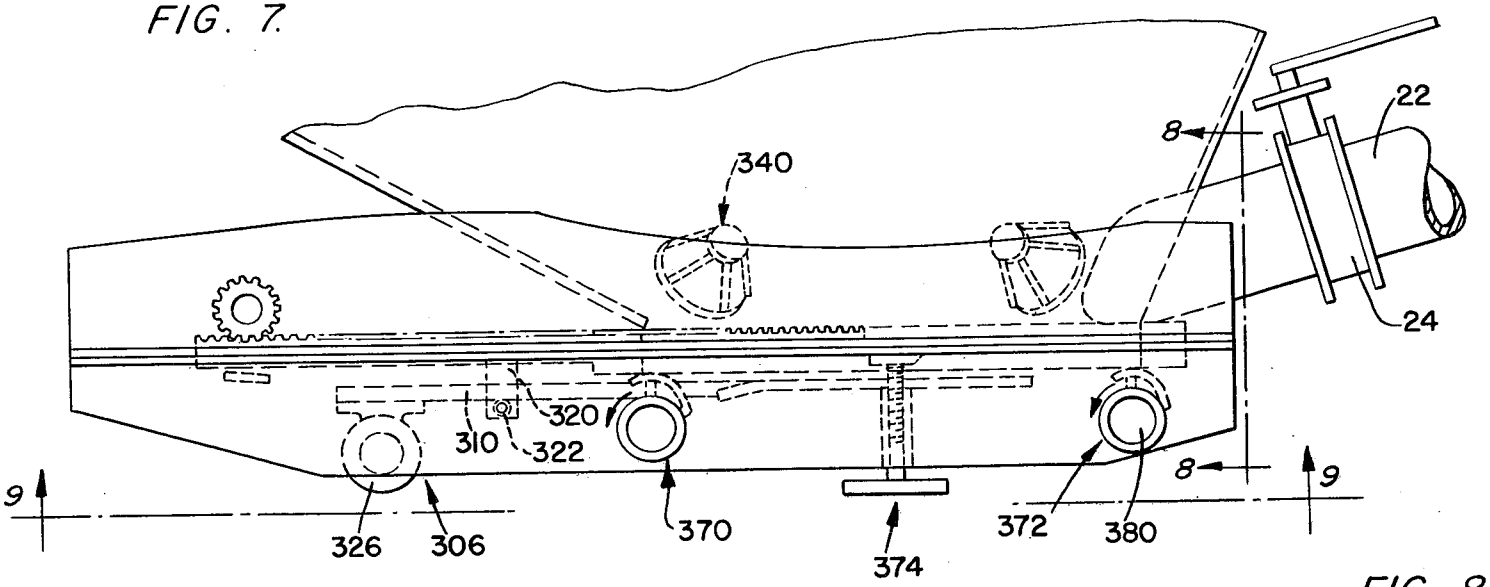
FIG. 7 is an elevation of another embodiment of the hopper bottom assembly embodying the teachings of the present invention and which has been tilted toward the horizontal as shown for the purpose of economy of space in the drawings.
Figure 8:
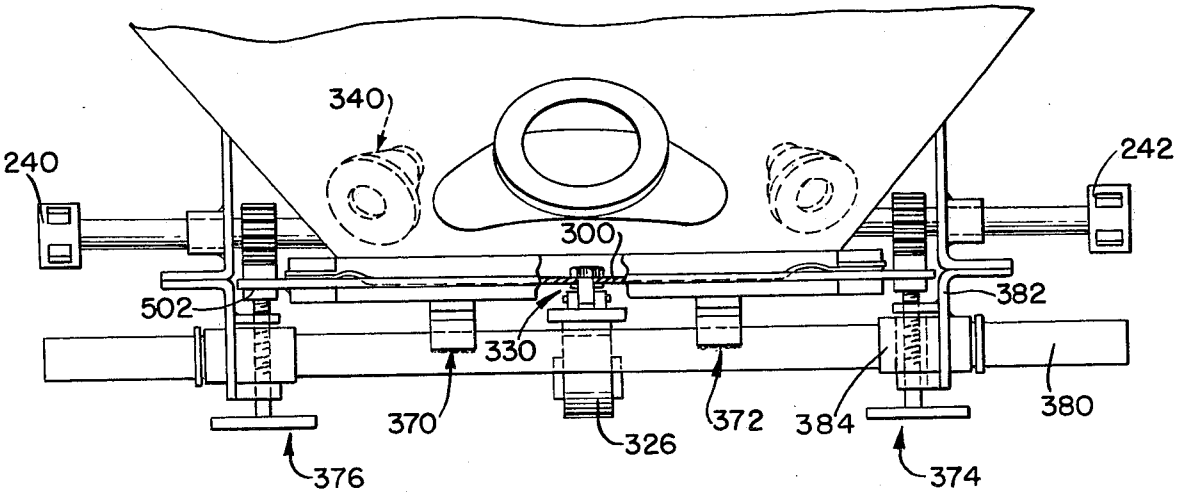
FIG. 8 is an elevation view taken along line 8—8 of FIG. 7.

As best shown in FIGS. 7 and 8, membrane 300 is supported by the membrane support assembly. Membrane 300 is preferably a metal plate, and a vibrator means 306 is attached thereto to set up an airsweep effect similar to that phenomenon discussed in the referenced patent applications. The vibrator means includes an elongate support strip 310 attached to the membrane by brackets 320 and bar 322 as best indicated in FIG. 7. A vibrator 326 is mounted at one end of the strip 310 by a bolt and clevis assembly 330, and the other end of the strip is attached to the membrane at or near the center thereof. Vibration produced by the vibrator 326 is thus transmitted to the membrane.

Aeration devices 340 are mounted in the hopper wall, and such devices are fully discussed in U.S. Pat. No. 3,929,261, the disclosure of which is fully incorporated herein by reference thereto.

Figure 10:
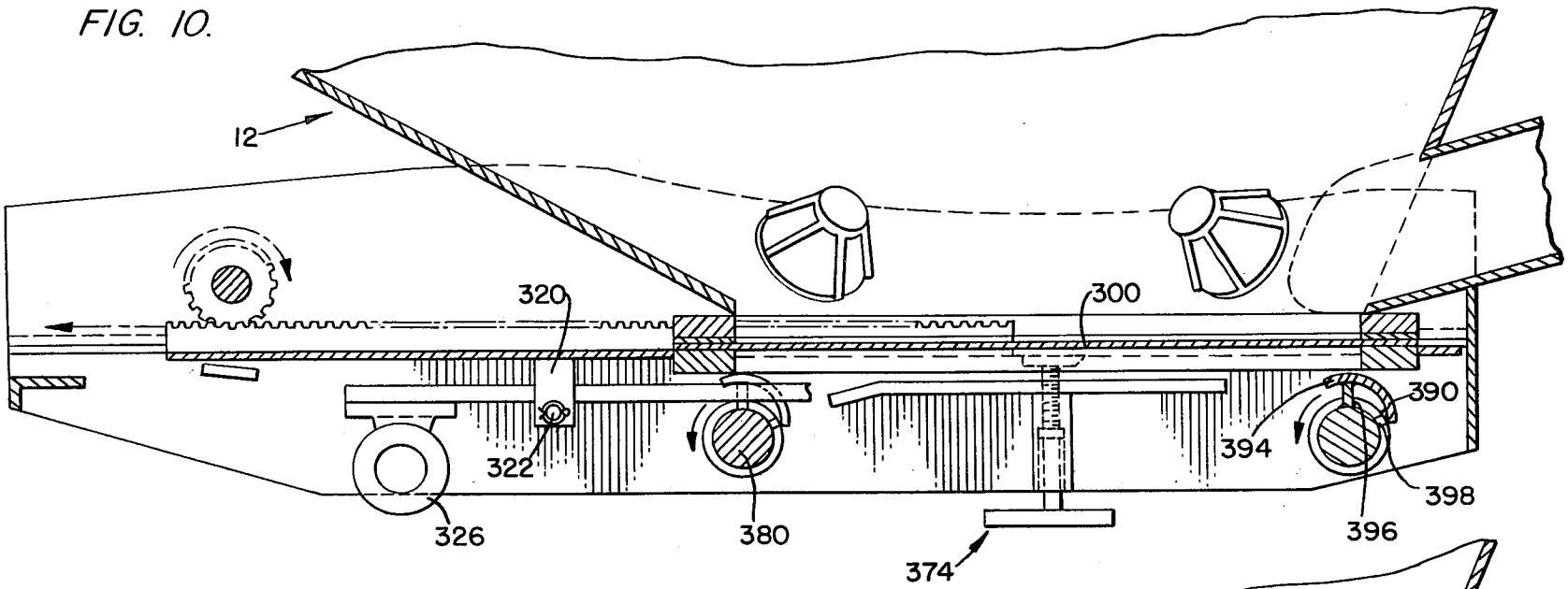
FIGS. 10 and 11 are views taken along line 10—10 of FIG. 9 showing the operation of the FIG. 7 embodiment of the hopper bottom assembly and which have been tilted toward the horizontal as shown for the purpose of economy of space in the drawings.
Figure 11:
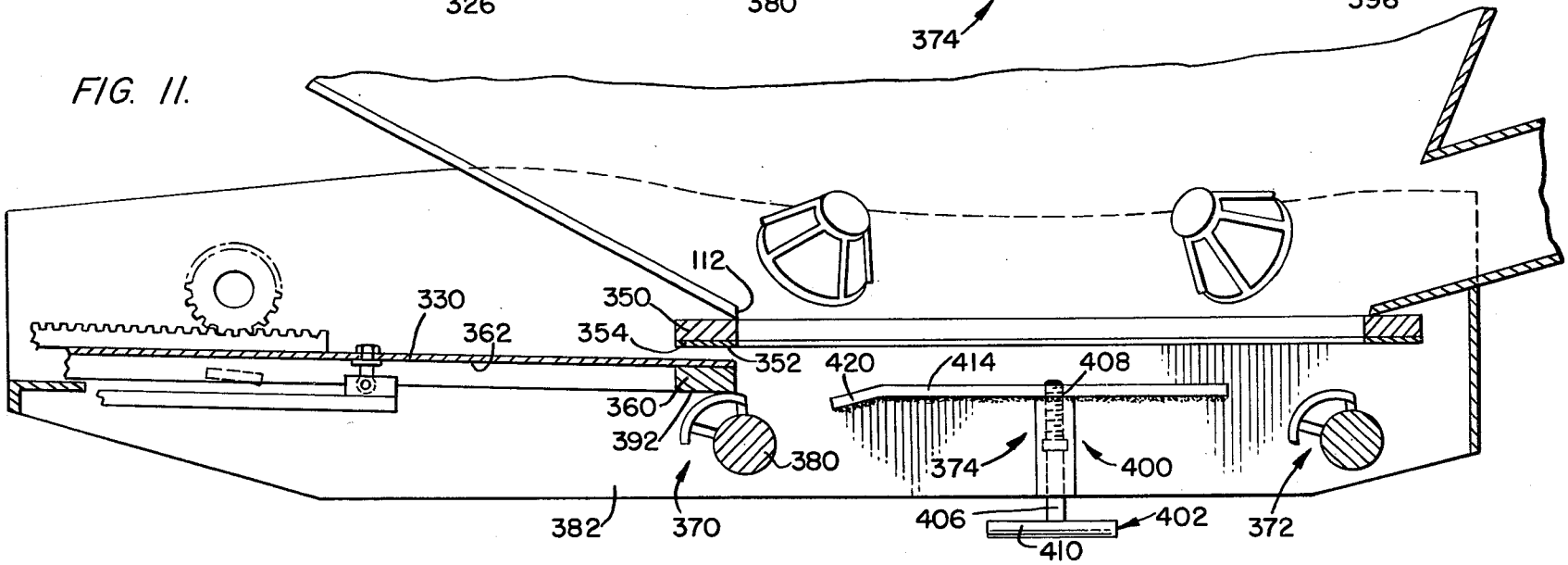

As most clearly shown in FIG. 11, an annular flange 350 surrounds the hopper bottom 112 and is affixed thereto by welding or the like. A gasket 352 is mounted on the bottom surface 354 of the flange 350. A flange 360 is circumferentially disposed on lower surface 362 of the membrane 330, and when the membrane is in the hopper opening occluding position shown in full lines in FIG. 9 and FIG. 10, the membrane is securely held against the gasket 352 to sealingly close the hopper opening 18.

Figure 9:
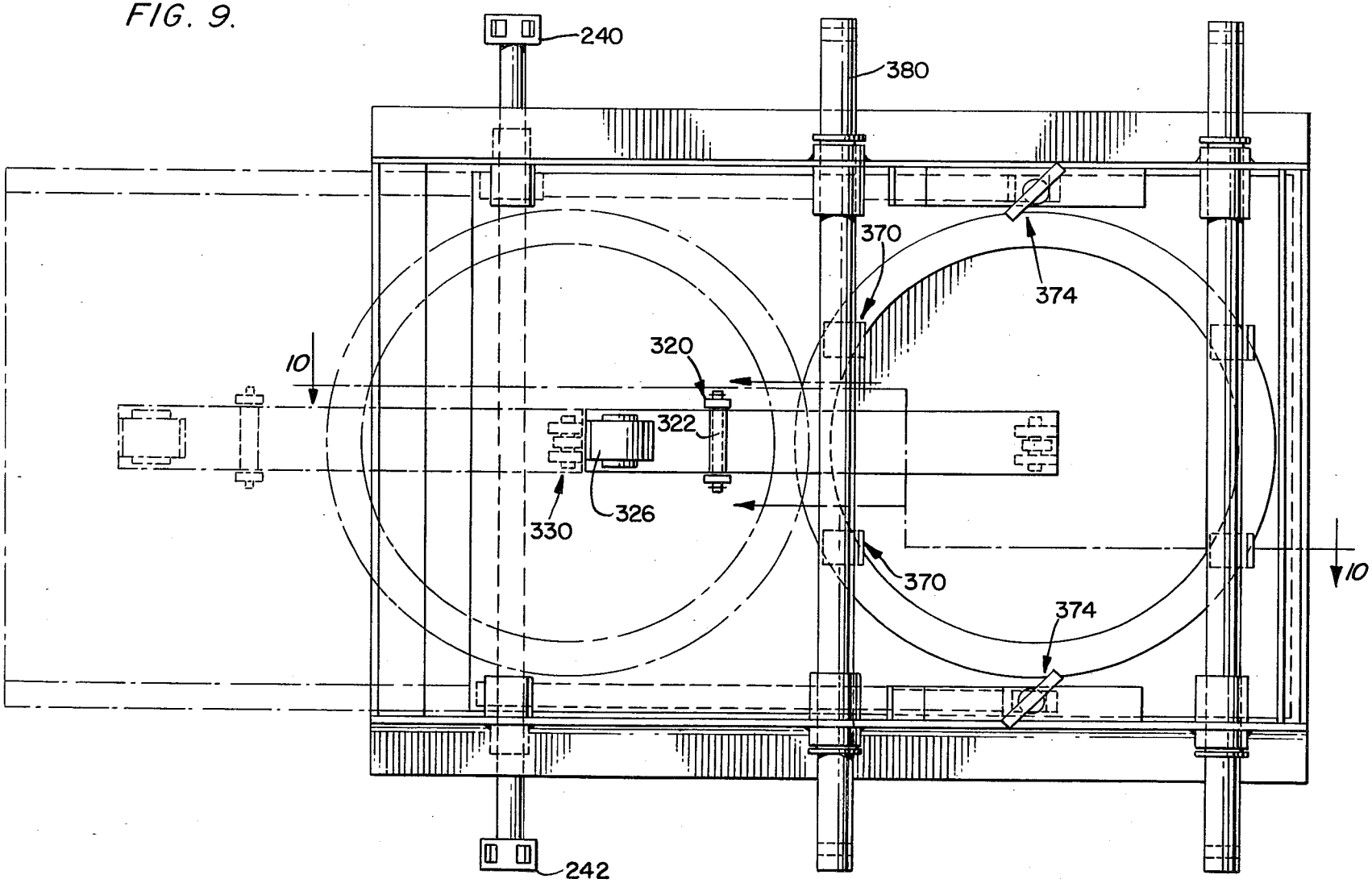
FIG. 9 is a view taken along line 9—9 of FIG. 7.

As shown in FIGS. 9–11, the membrane is forced against the hopper wall by cam assemblies 370 and 372 and bolt assemblies 374 and 376. Each cam assembly includes a cam shaft 380 mounted on a housing side member 382 by a bearing means 384. A pair of crescent-shaped cams 390 are mounted on each cam shaft to engage membrane flange bottom surface 392. Each cam includes a camming element 394 mounted on the cam shaft by supports 396 and 398. The crescent shape of the camming elements permits a jamming fit between the cam and the membrane flange which increases in tightness as the cam is rotated in one direction, and which loosens as the cam is rotated in the opposite direction.

Each bolt assembly includes a housing 400 mounted on a side wall member and a T-bolt 402 threadably received in that housing. Each T-bolt includes a shank 406 having threads 408 thereon, and a head 410 on one end of the shank. A lifting plate 414 is attached to each T-bolt for vertical movement therewith. Each lifting plate has an apron 420 on one edge thereof. The apron is sloped downwardly of the plate toward the T-bolt. Threadable movement of the T-bolts causes the lifting plate to engage the membrane to jam that membrane against the hopper bottom wall. The aprons of the lifting plates form ramps which facilitate engagement between those plates and the membrane support assembly. The alternative embodiment includes an assembly moving system similar to the above-discussed assembly moving system 220. A rack and pinion combination causes movement of the alternative embodiment which is similar to the movement of the aforediscussed assembly 90. This movement is illustrated in FIGS. 9–11 and is effected after appropriately loosening and/or removing the T-bolts and rotating the cams. The cam shafts have couplings (not shown) for attaching those shafts to a bar (not shown). Couplings are located on both ends of the cam shafts shown in FIG. 9 so that the cams, like the rack and pinion assembly, can be operated from either side of a transport vehicle.

Both embodiments of the closure assembly fall away as the assembly is opened as seen in FIG. 5 and 11, which facilitates the smooth opening and closing of the hopper opening.

A further alternative embodiment of the present invention includes a rack and pinion located on the bottom surface of the membrane support means. Thus, the rack in the further alternative embodiment is mounted on surface 500 of the bottom gate, and on surface 502 of the membrane support means of the alternative embodiment. The positions and orientation of the elements are altered appropriately to accommodate such location of the rack and pinion assembly.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A hopper bottom assembly comprising:

a hopper wall having upper and lower portions which define a bottom opening slanted in a plane with respect to the horizontal;

a product discharge manifold connected to said hopper wall adjacent said lower portion of said wall and above said bottom opening;

a hopper bottom opening closure assembly mounted on said hopper wall and including a housing, closure means slidably mounted in said housing to be moved in a plane substantially parallel to the plane of said bottom opening between a first position subjacent said bottom opening to a second position spaced from said bottom opening, said closure means including a slidably movable membrane movable between said first and second positions, and moving means for moving said closure means between said first and second positions;

closure sealing means for sealing said closure means to said hopper wall when said closure means is in said first position so that a hopper can be unloaded pneumatically, said sealing means including a plurality of clamping means for forcing said closure means toward said hopper wall; and means connected to said membrane for agitating the product in the hopper bottom adjacent said membrane during discharge of the product through said manifold.

2. The hopper bottom assembly defined in claim 1 wherein said moving means includes a rack and pinion assembly.

3. The hopper bottom assembly defined in claim 2 wherein said clamping means include ramp means for lifting said closure means.

4. The hopper bottom assembly defined in claim 3 wherein at least some of said ramp means include threaded means mounted on said housing for moving said ramp means.

5. The hopper bottom assembly defined in claim 4 further including a shaft connected to said pinion and a coupling on said shaft for releasably attaching said shaft to a means for rotating said pinion.

6. The hopper bottom assembly defined in claim 4 wherein said threaded means include a plurality of clamping bolts.

7. The hopper bottom assembly defined in claim 6 wherein said membrane is foraminous and further including a base plate and membrane support means on said base plate supporting portions of said membrane spaced from said base plate to define a plenum.

8. The hopper bottom assembly defined in claim 7 further including air induction means mounted on said base plate for conducting air into said plenum.

9. The hopper bottom assembly defined in claim 8 wherein said bottom opening is located in a plane which is tilted with respect to the horizontal.

10. The hopper bottom assembly defined in claim 4 wherein said threaded means includes a T-bolt.

11. The hopper bottom assembly defined in claim 10 wherein said clamping means include a plurality of cams.

12. The hopper bottom assembly defined in claim 11 wherein said cams are mounted on a cam shaft which extends across said housing and further including couplings on said cam shaft for connecting said cam shaft to a means for rotating said cam shaft.

13. The hopper bottom assembly defined in claim 12 wherein said cam shaft couplings are located on both ends of said cam shaft so that said cam shaft can be driven from either side of said housing.

14. The hopper bottom assembly defined in claim 4 wherein said membrane is fluid impervious and further including vibrator means connected to said membrane.

15. The hopper bottom assembly defined in claim 14 further including fluidizing means mounted on said hopper wall inside the hopper.

16. The hopper bottom assembly defined in claim 2 wherein said rack and pinion assembly includes a pair of racks and a pair of pinions with one rack and one pinion being located on one side of said housing and the other rack and pinion being located on another side of said housing.

17. The hopper bottom assembly defined in claim 16 further including a drive shaft mounted on said housing and connected to said pinions and couplings on each end of said drive shaft for connecting said drive shaft to a driving means from two sides of said housing.

18. The hopper bottom assembly defined in claim 1 wherein said bottom opening is located in a plane which is tilted with respect to the horizontal.

19. The hopper bottom assembly of claim 1 wherein said closure means comprises a base plate, said membrane is mounted on said base plate, and said base plate and membrane are simultaneously slidably moved between said first and second positions by said moving means.

20. The hopper bottom assembly of claim 19 wherein said membrane is foraminous, and air induction means connected to said membrane for agitating the product adjacent said membrane.

21. The hopper bottom assembly of claim 20 wherein said bottom opening is located in a plane which is tilted with respect to the horizontal toward said discharge manifold.

22. The hopper bottom assembly of claim 1 wherein said membrane is fluid impervious and constitutes said closure means.

23. The hopper bottom assembly of claim 22 including vibrator means connected to said membrane for agitating the product adjacent said membrane.

24. The hopper bottom assembly of claim 23 wherein said bottom opening is located in a plane which is tilted with respect to the horizontal toward said discharge manifold.

25. The hopper bottom assembly of claim 23 including fluidizing means mounted on said hopper wall inside said hopper and adjacent said membrane for agitating the product.

26. A hopper bottom assembly comprising:

a hopper wall having upper and lower portions which define a bottom opening slanted in a plane with respect to the horizontal;

a product discharge manifold connected to said hopper wall adjacent said lower portion of said wall and above said bottom opening;

a hopper bottom opening closure assembly mounted on said hopper wall and including a housing, a base plate slidably mounted in said housing to be moved in a plane substantially parallel to the plane of said bottom opening between a first position subjacent said bottom opening to a second position spaced from said bottom opening, a foraminous membrane mounted on said base plate and slidably movable therewith between said positions, and base plate moving means for moving said base plate between said first and second positions; and closure assembly sealing means for sealing said closure assembly to said hopper wall when said base plate is in said first position so that a hopper can be unloaded pneumatically, said sealing means including a plurality of clamping means for forcing said base plate toward said hopper wall.

* * * * *

UNITED STATES PATENT AND TRADEMARK OFFICE

CERTIFICATE OF CORRECTION

PATENT NO. : 4,360,295

DATED : November 23, 1982

INVENTOR(S) : Arthur I. Anderson

It is certified that error appears in the above-identified patent and that said Letters Patent are hereby corrected as shown below:

Col. 3, line 65, "the", second occurrence, should read -- The --.

Col. 4, line 13 - delete "is" and insert --if--.

Col. 4, line 54 - delete "174" and insert --44--.

Col. 7, line 28 - delete "FIG." and insert --FIGS.--.

Signed and Sealed this

*First* Day of *February 1983*

[SEAL]

*Attest:*

GERALD J. MOSSINGHOFF

*Attesting Officer*

*Commissioner of Patents and Trademarks*